US006334287B1

(12) United States Patent
Fick

(10) Patent No.: US 6,334,287 B1
(45) Date of Patent: Jan. 1, 2002

(54) WALL HINGE

(76) Inventor: Theodore Fick, 857 Fox Dr., Fox Island, Pierce County, WA (US) 98333

( * ) Notice: Subject to any disclaimer, the term of this patent is extended or adjusted under 35 U.S.C. 154(b) by 0 days.

(21) Appl. No.: 09/678,636

(22) Filed: Oct. 3, 2000

(51) Int. Cl.[7] ..... E04G 21/14; E05D 1/02

(52) U.S. Cl. ..... 52/745.11; 52/712; 16/226; 16/384

(58) Field of Search ..... 52/69, 712, 745.11, 52/745.14; 16/226, 391, 382, 384, 225, 234, 390

(56) References Cited

U.S. PATENT DOCUMENTS

| | | | | |
|---|---|---|---|---|
| 3,328,859 A | | 7/1967 | Stevens | |
| 3,561,039 A | * | 2/1971 | Amrein | 16/226 |
| 4,179,857 A | | 12/1979 | Danford | |
| 4,696,132 A | * | 9/1987 | LeBlanc | 52/69 |
| 4,976,075 A | | 12/1990 | Kaveckis | |
| 5,444,944 A | | 8/1995 | Roelofsz | |
| 5,833,430 A | | 11/1998 | Reynolds | |

FOREIGN PATENT DOCUMENTS

| | | | | |
|---|---|---|---|---|
| GB | 605291 | * | 7/1948 | 16/391 |

* cited by examiner

*Primary Examiner*—Michael Safavi
(74) *Attorney, Agent, or Firm*—James F. Leggett

(57) ABSTRACT

A wooden studwall is erected utilizing a hinge, of metal plate, having a bottom plate, two outer legs and a center leg extending from one side of the bottom plate so that the hinge can be aligned, along a chalk snap line located along the subfloor, where a wooden studwall is to be placed and the bottom plate and center leg can be nailed to the subfloor. The two outer legs, are bent up ninety degrees to the bottom plate, and are nailed to the underside of sole plate at the bottom of the stud wall so that when the wooden stud wall is raised the sole plate does not slip and is correctly aligned with the chalk snap line when the wooden stud wall is in the vertical position. The two outer legs may be left flat, parallel to the bottom plate, for safety reasons and then, after the bottom plate is nailed to the subfloor, bent up perpendicular to the subfloor and attached to the bottom sole plate of the stud wall.

6 Claims, 5 Drawing Sheets

WALL HINGE

BACKGROUND OF THE INVENTION

This invention relates to the construction of wood framed buildings or buildings in which prefabricated walls are set upon a subfloor and rotated to a vertical position. This improved device is an inexpensive and safe aid to properly locating the wall and accurately raising it into position.

In the construction of wood framed buildings it is known that metal brackets can aid in securing one member to another and increasing the strength of the structure and speed of assembly. It is also well known that walls of such a structure can be more efficiently fabricated when lying flat and then raised into position. However, the construction industry has wrestled with the instability of the prefabricated wooden stud walls while they are raised into position. The horizontal stringer, sole plate, on the bottom of the stud wall tends to slip or slide when the top of the stud wall is raised so that blocks have to be nailed to the subfloor to hold it, see Reynolds U.S. Pat. No. 5,833,430, or at least one worker must hold the bottom horizontal stringer, sole plate, in position. Blocks, such as suggested in Reynolds, pose a safety hazard to workmen traversing the subfloor so they cannot be set in place in advance. This problem also exists in the hinge and shelf system disclosed in Roelofsz U.S. Pat. No. 5,444,944 and Stevens U.S. Pat. No. 3,328,859.

The modular construction industry utilized two leg flat single plate hinges and flexible hinge bands for reducing the dimensions of a modular building's roof, see Danford U.S. Pat. No. 4,179,857 and Kaveckis U.S. Pat. No. 4,976,075, but the units still had to be realigned when set into final position.

SUMMARY OF THE INVENTION

Accordingly, it is an object of the present invention to provide a device which is inexpensive to manufacture, easy to use in wood frame construction and able to be prepositioned and the wooden stud wall fabricated in place at the job site and method to utilize it. This invention satisfies these objectives in that it is made from a single sheet of metal and can be stamped or cut out thereof by any standard means, boxed, shipped and stored so as to minimize space requirements. On the construction site, the invention can be prepositioned on the subfloor. When the wooden stud wall is ready to be fabricated, the horizontal stringer, sole plate, at the bottom of the wooden stud wall can be nailed to the two outer legs and the wooden stud wall constructed flat on the subfloor and then raised to the vertical and the invention is left in place. Of course, the wooden stud wall can be fabricated at another location and then brought to and nailed to the two outer legs before being raised to vertical.

The preferred embodiment of the device, Wall Hinge, is comprised of a flat metal plate having a bottom plate, three legs cut from one side, with the wider outer legs' inside edges being tapered, i.e. wider at the end farthest from the bottom plate, while the sides of the center leg remain parallel and perpendicular to the bottom plate. The bottom plate has round holes therein to accommodate nails and the legs each have elongated holes to accommodate nails therein, and the outer legs have at least one round hole near the end away from the bottom plate to accommodate a nail therein, so that the Wall Hinge can be placed upon the subfloor of a wood framed home under construction in juxtaposition that the snapped chalk line to set the location of the stud wall on the sub floor transects the point of joinder of the legs to the bottom plate, and the bottom plate and center leg nailed to the subfloor while the outer legs are perpendicular thereto and nailed to the underside of the horizontal stringer, sole plate, at the bottom of the wooden stud wall.

The novel features of the invention and method for its use will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

DESCRIPTION OF THE PREFERRED EMBODIMENTS

Figure 1:
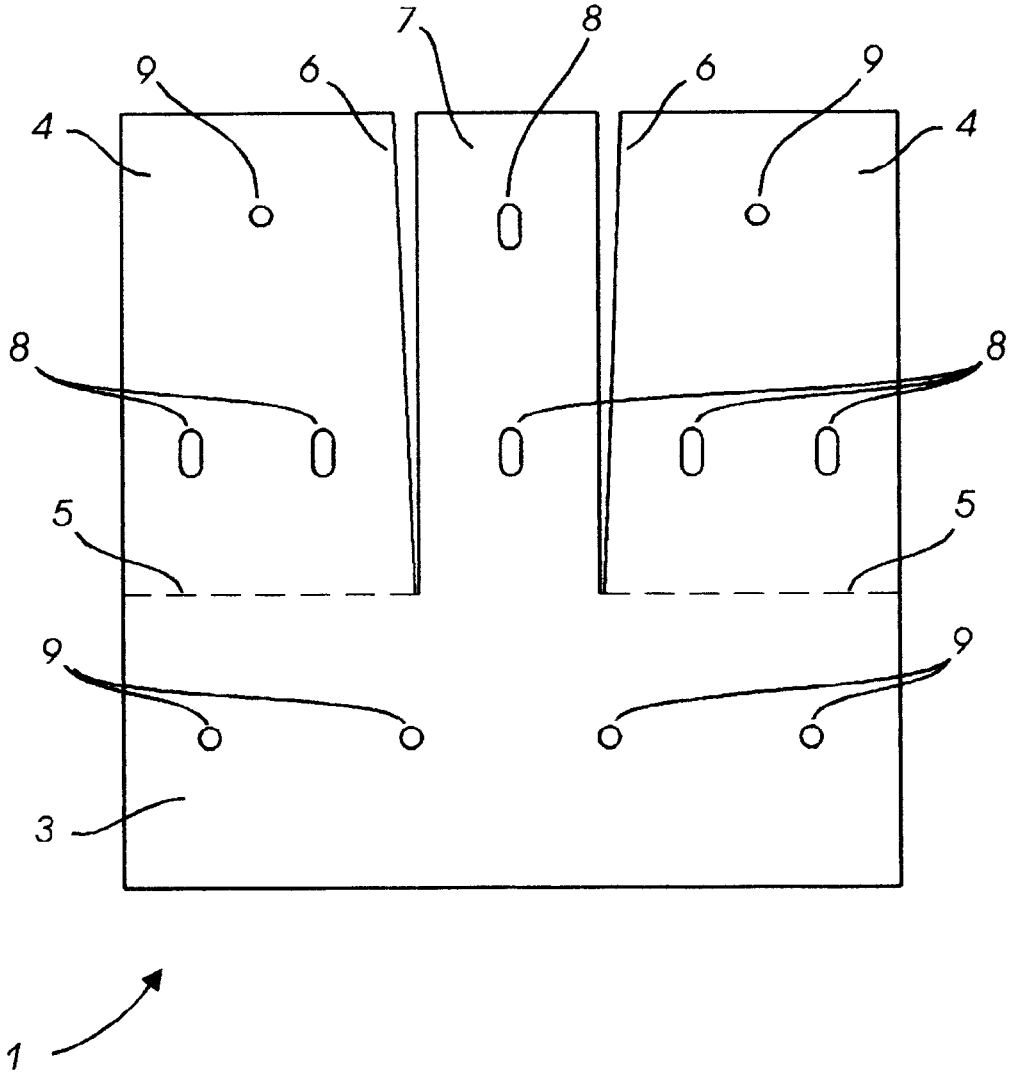
FIG. 1 is a perspective view of the Wall Hinge.
Figure 2:
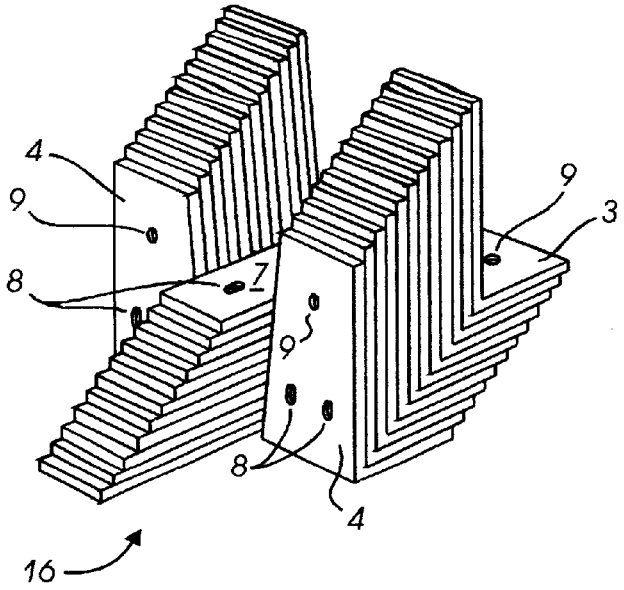
FIG. 2 is a perspective view of a stack of wall hinges.

With specific reference to FIG. 1 and FIG. 2, the Wall Hinge (1) is shown in its position as manufactured, stacked (16), shipped, stored and installed prior to attachment to a wooden stud wall (12), being comprised of flat metal plate, such as 18 Gauge Galvanized Sheet Metal, having been stamped or cut out in a square or rectangular over all shape, five inches wide along the bottom plate (3) and four inches long with the legs three inches long for accommodating 2×4 and 2×6 construction lumber, and having a bottom plate (3), five inches by one inch for accommodating 2×4 and 2×6 construction lumber, and three legs, of equal length, extending from one side of the bottom plate (3) and formed by two tapered slots (6), wiser at the end opposite the bottom plate (3) so as to avoid impingement upon the center leg (7) should there be any twisting when the wooden stud wall (12) is raised, cut in the flat metal plate, the center leg (7) having sides adjacent to the tapered slots (6) being parallel and perpendicular to the bottom plate (3) and communicating undeterred with the bottom plate (3) while the point of joinder (5) of the outer legs (4) to the bottom plate (3) being weakened and the outer legs (4) being bent ninety degrees to the bottom plate (3) during manufacture and the bottom plate equipped with round holes (9) to accommodate nails (17) and all three legs being provided with elongated nail holes (8) to accommodate nails (17), while the outer legs (4) are provided with at least one round nail hole (9) near the end farthest from the bottom plate (3) to minimize twisting, said round nail holes (9) in the outer legs (4) located ¾ inch from the end thereof to accommodate 2×4 and 2×6 construction lumber.

Figure 3:
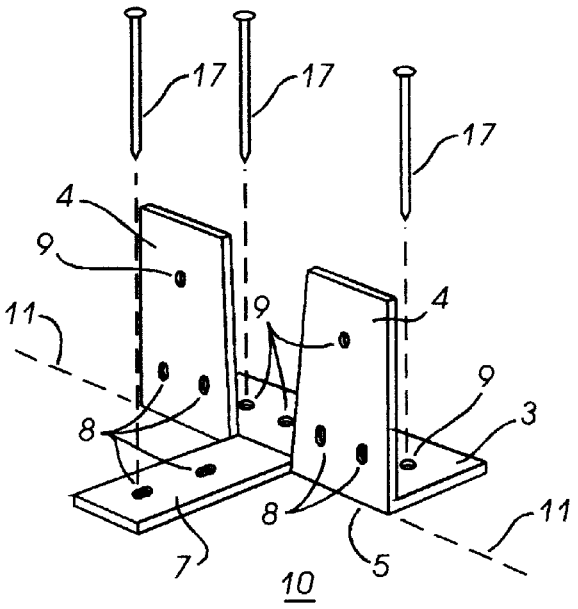
FIG. 3 is a perspective view of the Wall Hinge located on a subfloor along a chalk line.
Figure 4:
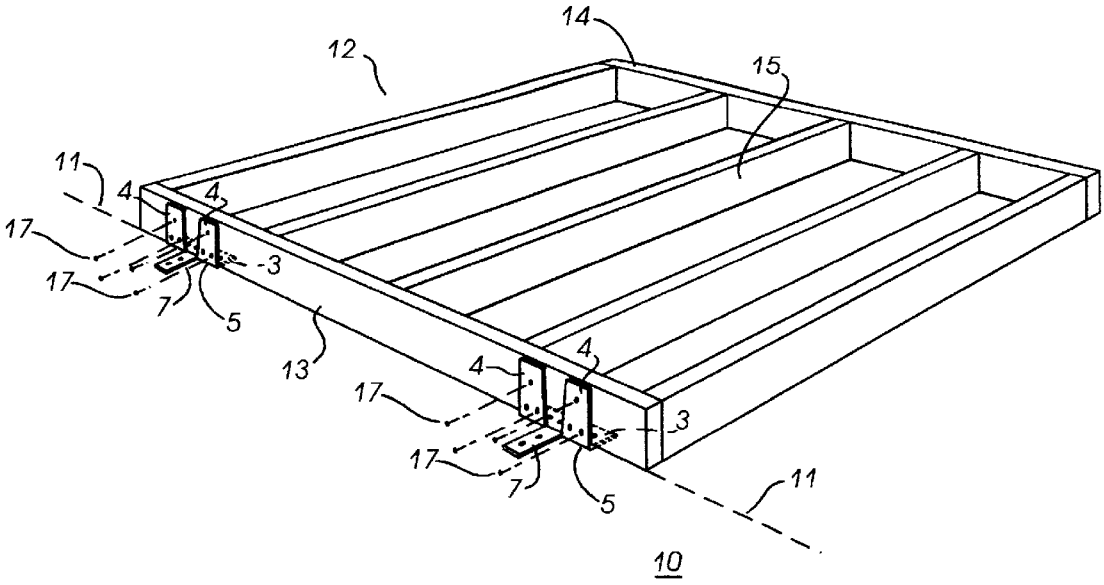
FIG. 4 is a fragmentary perspective view of the Wall Hinge joined to the underside of the horizontal stringer, sole plate, at the bottom of the wooden stud wall before raising.

With reference to FIGS. 3 and 4, the Wall Hinge (1) is shown with the bottom plate (3) and center leg (7) fastened to the subfloor (10) oriented along a chalk snap line (11) so said chalk snap line (11) transects the Wall Hinge (1) at the point of joinder (5) of the outer legs (4) to the bottom plate (3) and the outer legs (4) having been bent up ninety degrees to vertical in relation to the bottom plate (3) at the time of manufacture and said outer legs (4) having been nailed (17) to the underside (13) of the horizontal stringer (14), which is referred to as a sole plate in the construction industry, at the bottom (19) of a wooden stud wall (12) comprised of a horizontal stringer (14) on the top (18) of the wooden stud wall and on the bottom (19) of the wooden stud wall and one or more vertical studs (15) communicating there between.

Figure 5:
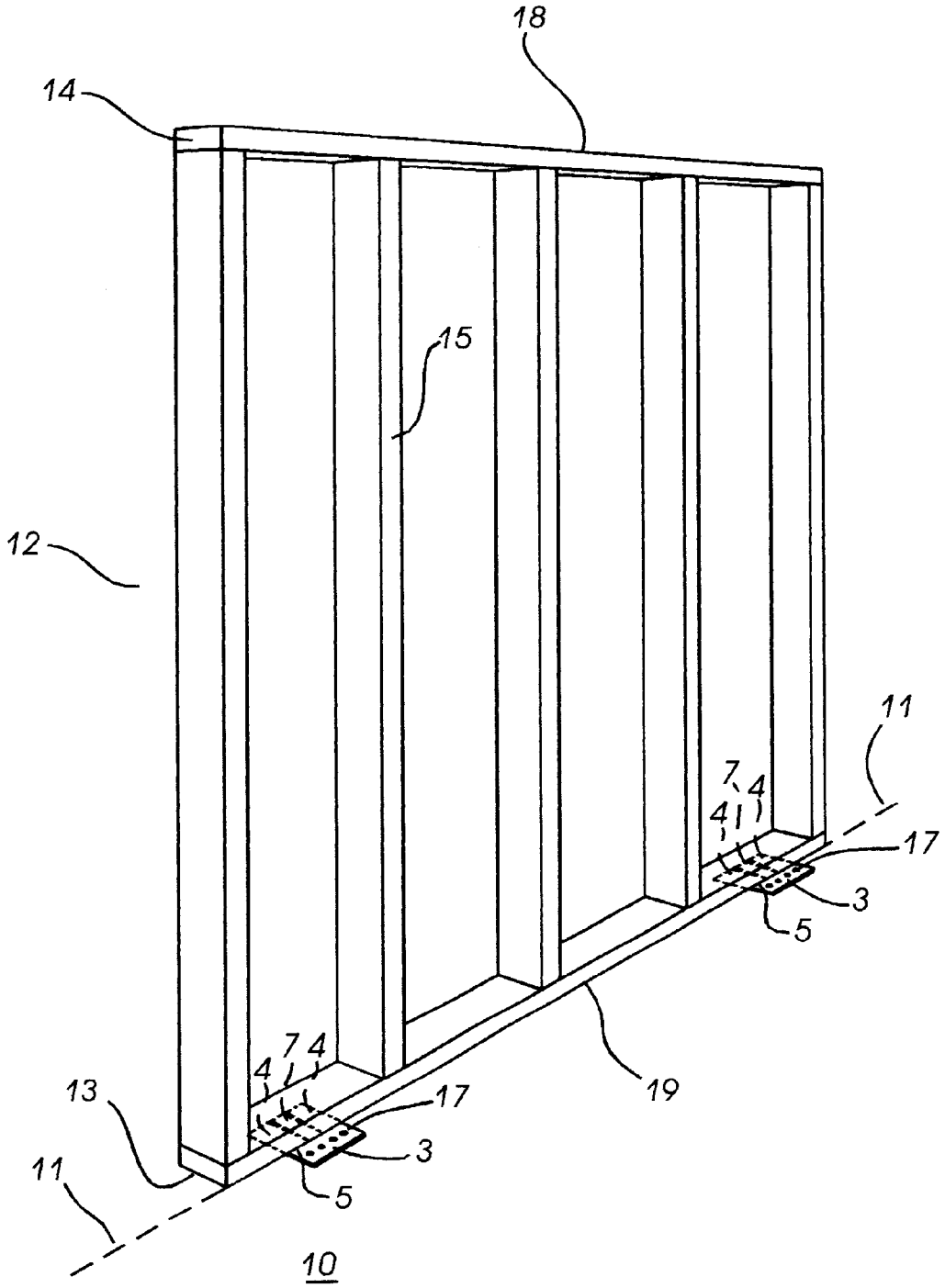
FIG. 5 is a fragmentary perspective view of the wall hinge and the wooden stud wall in its vertical position.

FIG. 5 shows the wooden stud wall (12) in its vertical position, resting on the center leg (7) and the two outer legs (4), still properly aligned to the chalk snap line (11) and securely nailed (17) through the center leg (7) and the bottom plate (3) to the subfloor (10).

With reference to FIGS. 4 and 5, the Wall Hinge provides an improved method of aligning and anchoring a wooden stud wall (12), having a horizontal stringer (14) at the top (18) and the bottom (19) and two or more vertical studs (15) communicating there between and said horizontal stringer (14), sole plate, at the bottom (19) having an underside (13), by scribing the intended location of the wooden stud wall (12) on a subfloor (10) by a chalk snap line (11); positioning one or more Wall Hinges (1) so that the point of joinder (5) of the outer legs (4) to the bottom plate (3) lay on the chalk snap line (11) and nailing (17) the bottom plate (3) and center leg (7) to the subfloor (10) thereat; attaching the wooden stud wall (12) to the subfloor (10) by nailing the outer legs (4) to the underside (13) of the horizontal stringer (14), sole plate, at the bottom (19) of a prefabricated wooden stud wall (12) or fabricating the wooden stud wall (12) horizontally on the subfloor (10), while said horizontal stringer (14), sole plate, is laying on the bottom plate (3); and raising the horizontal stringer (14) at the top (18) of the wooden stud wall (12), thus rotating the horizontal stringer (14), sole plate, at the bottom (19) of the wooden stud wall (12) around the wall hinge (1) and bending the outer legs (4) into a flat position in relation to the center leg (7), bottom plate (3) and subfloor (10).

Figure 6:
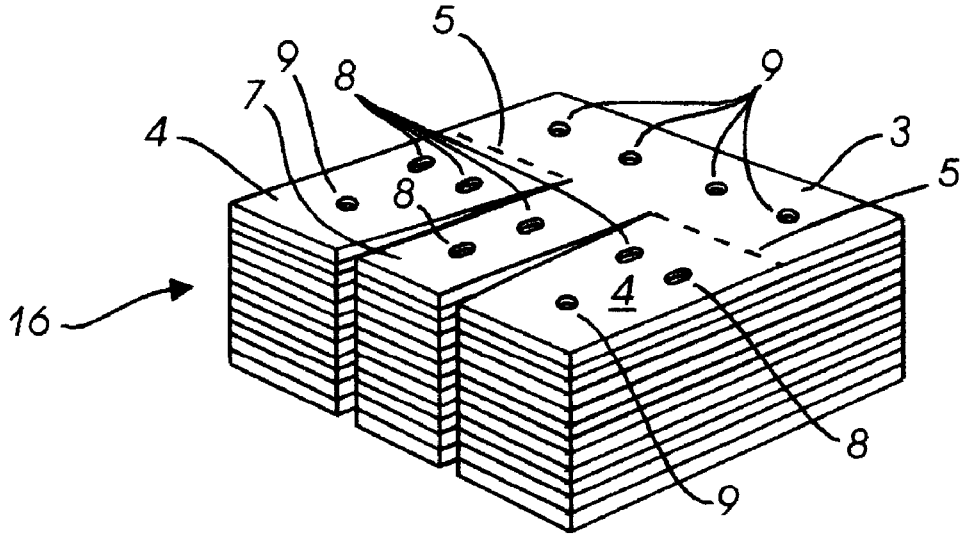
FIG. 6 is a perspective view of a stack of alternatively configured wall hinges.

FIG. 6 discloses an alternative method of construction of the wall hinge (1) wherein it is made in a flat configuration with the outer legs (4) having been weakened by striation or indentation at the point of joinder (5) to the bottom plate (3), so that the wall hinges (1) can be packaged, shipped and installed flat on the subfloor (10) and the outer legs (4) are not bent up, perpendicular to the bottom plate (3) and subfloor (10), until immediately prior to attachment to the underside (13) of the horizontal stringer (14), sole plate, at the bottom (19) of the wooden stud wall (12).

Accordingly, it is understood that within the scope of the claims appended hereto, the invention may be practiced otherwise than as specifically disclosed herein.

I claim:

1. An improved wall hinge device aligning and anchoring a wooden stud wall, having a bottom and a top and a sole plate, with an underside, on the bottom and a horizontal stringer on the top and one or more vertical studs communicating there between, the wall hinge comprised of a metal plate having a bottom plate and three legs extending from one side thereof along a line of joinder with the bottom plate, the three legs being of equal length and formed by two tapered slots, wider at the end opposite to the bottom plate, each slot having been formed between a respective side of a center leg and a respective outer leg of the three legs the sides of the center leg being parallel to each other and perpendicular to the bottom plate, with the point of joinder of the outer legs to the bottom plate having been weakened and bent ninety degrees to the bottom plate, said bottom plate having round holes therein to accommodate a means to fixedly attach it to a subfloor and the legs having elongated holes, the outer legs having at least one round nail hole near the end farthest from the bottom plate, therein to accommodate a means to fixedly attach the center leg to the subfloor and the outer legs to the underside of the sole plate at the bottom of the wooden stud wall, so that once the wall hinge is aligned with a chalk snap line on the subfloor and the bottom plate and center leg are secured in place, the outer legs, bent ninety degrees to vertical, are secured to the underside of the sole plate at the bottom of the wooden stud wall, which wooden stud wall can be fabricated horizontally on the subfloor or fabricated elsewhere and brought into position and nailed to the outer legs, and the wooden stud wall can be raised into exact alignment with the chalk snap line.

2. The improved wall hinge of claim 1 wherein the bottom plate is one inch by five inches and the three legs extending therefrom are three inches long and the center leg is one inch wide with parallel sides and the outer legs are two inches wide at the point of joinder to the bottom plate and slightly less in width at the end opposite to the bottom plate so that the sides of the outer legs adjacent to the tapered slot will not impinge on the center leg when the wooden stud wall is raised into position in case there is some twisting in the raising process.

3. The improved wall hinge of claim 1 wherein the metal plate is constructed of 18 gauge galvanized sheet metal.

4. The improved wall hinge of claim 1 wherein the wall hinge is manufactured in a flat configuration with the outer legs having been weakened by striation or indentation at the point of joinder to the bottom plate, so that the wall hinge can be stored, shipped and prepositioned on the subfloor and the outer legs bent up to perpendicular to the base plate and subfloor only when the wooden stud wall is ready to be attached.

5. An improved method of aligning and anchoring a wooden stud wall, having a horizontal stringer at the top and a sole plate at the bottom and two or more vertical studs communicating there between, said sole plate, at the bottom of the wooden stud wall having an underside, said method comprising the steps of:

scribing the intended location of the wooden stud wall on a subfloor by a chalk snap line;

positioning at least one wall hinge of claim 1 so that the point of joinder of the outer legs to the bottom plate lies on the scribed line and nailing the bottom plate and center leg to the subfloor thereat;

attaching the wooden stud wall to the subfloor by nailing the outer legs of the wall hinge to the underside of the sole plate while said sole plate is lying on the bottom plate, the outer legs being perpendicular in relation to the subfloor and the bottom plate;

raising the horizontal stringer at the top of the wooden stud wall, thus rotating the sole plate at the bottom of the wooden stud wall around the wall hinge and bending the outer legs into a flat position in relation to the center leg, the bottom plate, and the subfloor.

6. The improved method of claim 5 wherein the sole plate at the bottom of the wooden stud wall is nailed to the outer legs of the wall hinge and the wooden stud wall is then fabricated thereon horizontal to the subfloor and then raised perpendicular to the subfloor.

* * * * *